US006091283A

United States Patent [19]

Murgula et al.

[11] Patent Number: 6,091,283

[45] Date of Patent: Jul. 18, 2000

[54] SUB-THRESHOLD LEAKAGE TUNING CIRCUIT

[75] Inventors: James E. Murgula, Hollis, N.H.; James B. Burr, Foster City, Calif.

[73] Assignee: Sun Microsystems, Inc., Palo Alto, Calif.

[21] Appl. No.: 09/028,469

[22] Filed: Feb. 24, 1998

[51] Int. Cl.[7] ..... G05F 3/02

[52] U.S. Cl. ..... 327/537; 327/535

[58] Field of Search ..... 327/307, 534, 327/535, 537, 546

[56] References Cited

U.S. PATENT DOCUMENTS

| | | | |
|---|---|---|---|
| 4,068,134 | 1/1978 | Tobey, Jr. et al. | 327/541 |
| 5,099,146 | 3/1992 | Miki et al. | 327/77 |
| 5,341,034 | 8/1994 | Matthews | 327/534 |
| 5,397,934 | 3/1995 | Merrill et al. | 327/537 |
| 5,874,851 | 2/1999 | Shiota | 327/537 |

*Primary Examiner*—Terry D. Cunningham

[57] ABSTRACT

To compensate for process, activity and temperature-induced device threshold variations in a semiconductor circuit having a transistor, a potential of the gate the transistor is held to a preset subthreshold potential, and a channel current of the channel region is compared with a reference current to obtain a comparison result. A bias potential of a substrate is adjusted according to the comparison result to hold the subthreshold current at the reference current.

10 Claims, 3 Drawing Sheets

SUB-THRESHOLD LEAKAGE TUNING CIRCUIT

BACKGROUND OF THE INVENTION

1. Field of the Invention

The present invention generally relates to semiconductor devices, and in particular, the present invention relates to a device and method for adjusting a substrate bias potential to compensate for process, activity and temperature-induced device threshold variations.

2. Description of the Related Art

FIG. 1 illustrates an example of a back-biased n-channel device. That is, in the exemplary MOS configuration of FIG. 1, the NFET 101 is a four-terminal device, and is made up of an n-region source 104, a gate electrode 103, an n-region drain 102, and a p bulk substrate 105. The substrate or bulk 105 of the NFET 101 is biased to Vbs (as explained below) by way of a metallic back plane 106.

FIG. 2 is a circuit representation of the NFET 101 of FIG. 1. As shown, Vgs is the voltage across the gate G and the source S, Vds is the voltage across the drain D and the source S, and Vbs is the voltage across the substrate B and the source S. Reference character Id denotes the drain (or channel) current.

There are a number of factors which contribute to the magnitude of a transistor device's threshold voltage. For example, to set a device's threshold voltage near zero, light doping and/or counter doping in the channel region of the device may be provided. However, due to processing variations, the exact dopant concentration in the channel region can vary slightly from device to device. Such process variations include, for example, variations in physical dimensions of the devices, and variations in dopant profiles. Although these variations may be slight, they can shift a device's threshold voltage by a few tens or even hundreds of millivolts. Further, trapped charges in the materials and at the interfaces can alter thresholds. Still further, environmental factors such as operating temperature fluctuations can shift the threshold voltage. Moreover, low threshold devices may leak too much when their circuits are in a sleep or standby mode. Thus, particularly for low-threshold devices, it is desirable to provide a mechanism for tuning the threshold voltage to account for these and other variations. This can be accomplished using back biasing, i.e. controlling the potential between a device's substrate and source. See James B. Burr, "Stanford Ultra Low Power CMOS," Symposium Record, Hot Chips V, pp. 7.4.1–7.4.12, Stanford, Calif. 1993, which is incorporated herein by reference for all purposes.

A basic characteristic of back-biased transistors resides in the ability to electrically tune the transistor thresholds. This is achieved by reverse biasing the bulk of each MOS transistor relative to the source to adjust the threshold potentials. Typically, as shown in FIG. 1, the potential will be controlled through isolated ohmic contacts to the source and bulk regions together with circuitry necessary for independently controlling the potential of these two regions.

However, as the threshold voltage varies with temperature, there exists a need to dynamically adjust the substrate bias voltage to compensate for such temperature induced variations in device performance. Furthermore, global process variations that would otherwise shift the threshold voltage should also be compensated by applying the appropriate offset to the substrate. While various techniques are known for adjusting the substrate bias for this purpose, they tend to be complex and expensive, and in some cases ineffective, particularly for low and near zero threshold voltage devices.

SUMMARY OF THE INVENTION

It is thus an object of the present invention to provide a semiconductor device structure and method which compensate for changes in device characteristics across process and temperature.

It is a further object of the present invention to provide a semiconductor device structure and method which compensate for changes in the threshold voltage of low threshold voltage devices across process and temperature.

According to one aspect of the present invention, a semiconductor device is provided which includes a transistor having a drain, a source, a channel region, a substrate and a gate; a first voltage source which holds a potential of said gate to a value at which a drain-to-source current through said channel is subthreshold; a constant current source which outputs a reference current; a comparator which compares the reference current with the subthreshold drain-to-source current through said channel; and a second voltage source which adjusts a bias potential of said substrate according to an output of said comparator to hold the subthreshold drain-to-source current at the reference current.

According to another aspect of the invention, a method is provided for compensating for temperature variations in a semiconductor circuit having a transistor, the transistor having a drain, a source, a channel region, a substrate and a gate, the method including holding a potential of the gate to a preset subthreshold potential; comparing a drain-to-source current of the channel region with a reference current to obtain a comparison result; and adjusting a bias potential of the substrate according to the comparison result to hold the subthreshold drain-to-source current at the reference current.

According to still other aspects of the present invention, the transistor is an enhancement mode n-channel transistor, the potential at which gate voltage is held by said voltage source is a negative potential.

According to other aspects of the present invention, the transistor is an enhancement mode n-channel transistor, the potential at which the gate voltage is held is between −500 mV and −50 mV, the reference current is between 0.01 and 100 nA, and the threshold is less than the gate voltage plus 500 mV.

According to still other aspects of the present invention, the transistor is an enhancement mode p-channel transistor, the potential at which gate voltage is held by said voltage source is a positive potential.

According to further aspects of the present invention, the transistor is an enhancement mode p-channel transistor, the potential at which the gate voltage is held is between +500 mV and +50 mV, the reference current is between −0.01 and −100 nA, and the threshold voltage is more than the gate voltage minus 500 mV.

BRIEF DESCRIPTION OF THE DRAWINGS

The above and other features and advantages of the present invention will become readily apparent from the description that follows, with reference to the accompanying drawings, in which.

DETAILED DESCRIPTION OF THE PREFERRED EMBODIMENTS

Figure 1:
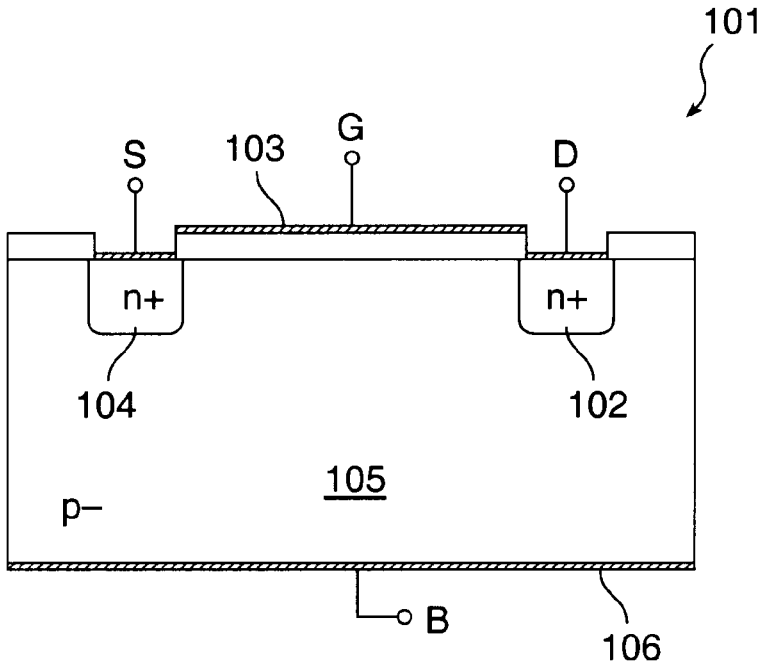
FIG. 1 illustrates conventional back-biased n-channel MOS configuration.
Figure 2:
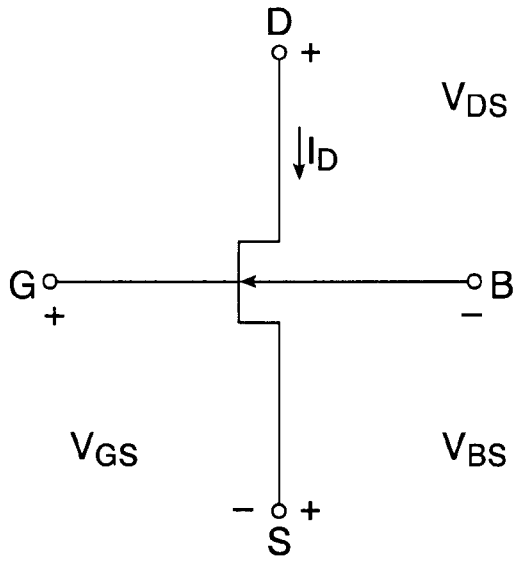
FIG. 2 is a circuit representation of the n-channel MOS configuration of FIG. 1.
Figure 3:
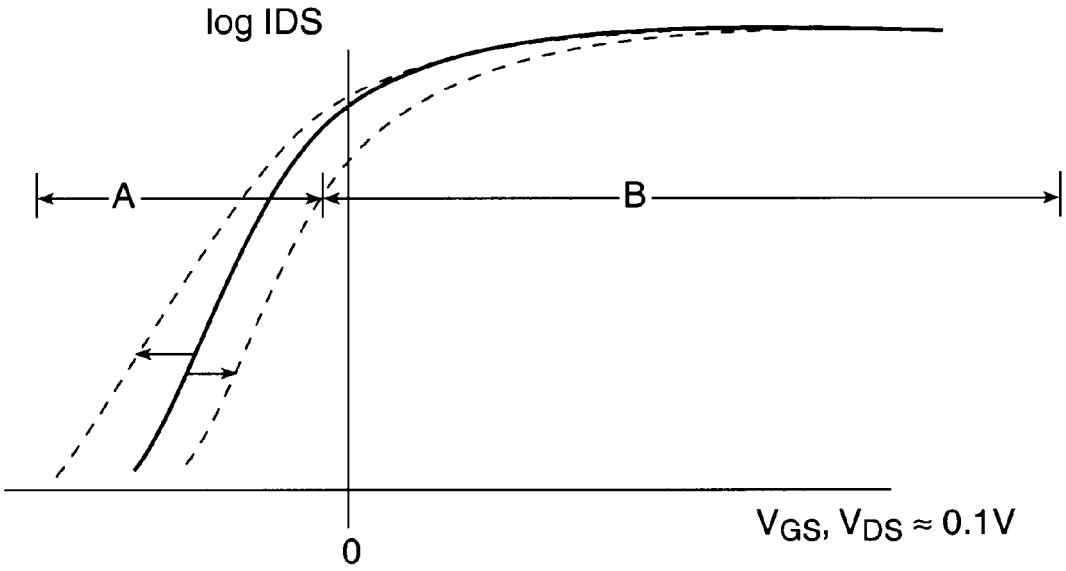
FIG. 3 a diagram which plots the drain current Id versus the gate voltage Vgs in the circuit representation of FIG. 2.

In low and near-zero voltage threshold devices, the gate voltage is largely negative in the subthreshold region. This is illustrated in the diagram of FIG. 3 which plots the drain current Id versus the gate voltage Vgs in the circuit representation of FIG. 2. The drain voltage Vds is set at a fixed value, for example 0.1 volts.

In a subthreshold region A, low and near-zero threshold devices exhibit an exponential increase (i.e., a linear increase on a logarithmic scale) in Id(sub.) with an increase in Vgs, which may be characterized as follows:

$$Id(\text{sub})\cong\mu_{eff}\cdot C_{ox}\cdot(W/L)\cdot n\cdot V_T^2\cdot e^X\cdot(1-e^Y), \quad \text{(eq. 1)}$$

where $X=(Vgs-V)nV_T$, where $Y=-Vds/V_T$, and where $V_T=kT/q$ and where $\mu_{eff}$ denotes electron surface mobility (which depends on the doping concentration in the channel region and the gate voltage), $C_{ox}$ is the gate oxide capacitance per unit area, W denotes the channel width, L denotes the channel length, n is a gate coupling coefficient, $V_t$ is the threshold voltage, Vgs is the gate voltage, VT is the so-called thermal voltage (e.g. 26 mV at room temperature or 300° K.), k is Boltzmann's constant, T denotes temperature (° K.), and q denotes the unit (electron) charge.

On the other hand, still referring to FIG. 3, where Vgs exceeds $V_t$ in the linear region B, the drain current Id(lin.) may be characterized as follows:

$$Id(\text{lin.})\cong\mu_{eff}\cdot C_{ox}\cdot(W/L)\cdot((Vgs-V_t)\ Vds-Vds^2/2). \quad \text{(eq. 2)}$$

where the variables are the same as those described above with respect to equation 1.

The threshold voltage decreases about 1 mV per 1° C. increase injunction temperature at a fixed bias. As illustrated by the dashed lines in FIG. 3, in the case of an n-channel device, as the temperature of the device increases, the subthreshold pattern is moved to the left. Conversely, as the temperature decreases, the subthreshold pattern is shifted to the right. In either case, the threshold temperature of the device is altered with such temperature fluctuations.

The technique of the present invention for adjusting the substrate bias to compensate for temperature fluctuations will now be described. According to this technique, the subthreshold current is maintained at a desired value. In low threshold devices, this requires driving the gate voltage below ground. In this scheme, the gate voltage of a test transistor is driven to a suitable fixed negative voltage, for example, between −500 mV and −50 mV. The drain current is compared to a preferably fixed reference current, for example, between 0.01 and 100 nA. If the drain current is larger than the reference current, the back bias is increased. If the drain current is less than the reference current, the back bias is decreased.

Figure 4:
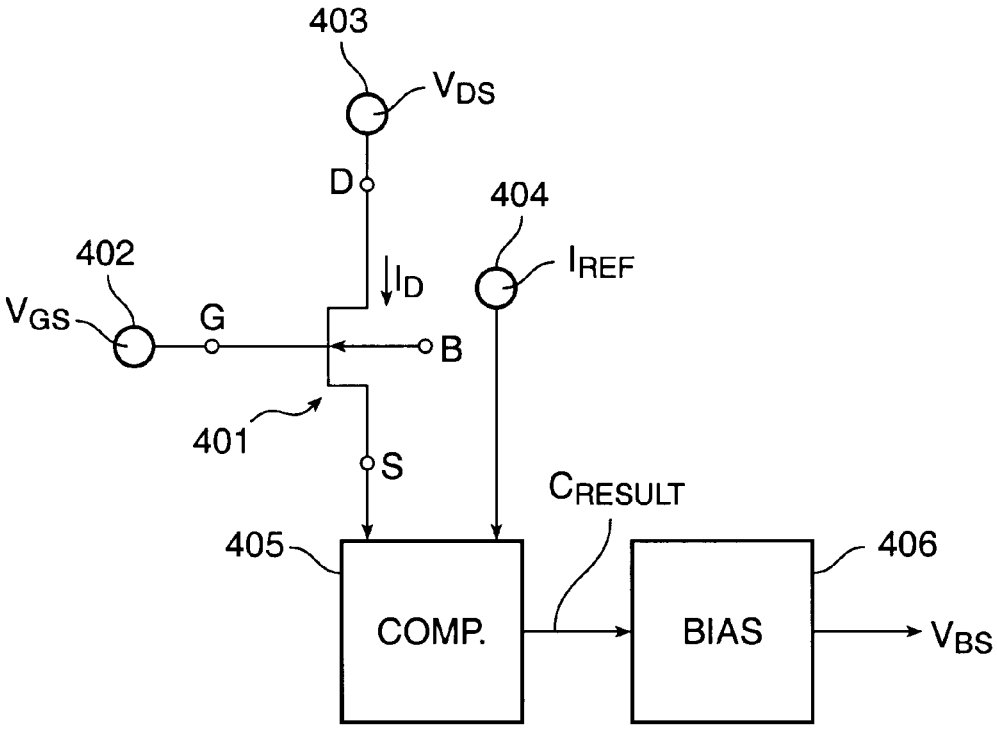
FIG. 4 is a diagram showing an exemplary circuit configuration for implementing the technique of the present invention for compensating for temperature variations in a semiconductor circuit.

Attention is now directed to FIG. 4 which is a diagram showing an exemplary circuit configuration for implementing the technique of the present invention. As shown, an enhancement mode n-channel MOS device 401 has its gate G coupled to a voltage source 402. The voltage source 402 is preferably a constant voltage source for fixing the gate potential Vgs to a potential at which the channel current Id is subthreshold. A second voltage source 403 is used to fix the drain potential Vds, and a current source 404 is used to generate the reference current Iref. A comparator 405 compares the drain current Id with the reference current Iref, and outputs a comparison result $C_{result}$. The comparison result Cresult is received by a substrate bias voltage generator 406 which increases or decreases the substrate bias according to $C_{result}$. Again, if the drain current is larger than the reference current, the back bias is increased by the substrate bias voltage generator 406. If the drain current is less than the reference current, the back bias is decreased by the substrate bias voltage generator 406. $C_{result}$ may be a single bit indicative of one of two states, e.g., a logic 1 indicating that the substrate bias should be increased and a logic 0 indicating that the substrate bias voltage should be decreased. Alternately, for example, the comparator 405 may be constituted by a window comparator to provide a dead band in the servomechanism.

The subthreshold currents in the circuit of FIG. 4 lead to very low static power dissipation. Assume Vgt (which equals Vgs−Vt) is to be held at −240 mV and that Iref is 1 nA. Also assume that at Vgs=Vt (i.e., Vgt=0), Ids is about 1 μA. If the subthreshold slope is 80 mV/decade, then at Vgt=−240 mV, Ids is about 1 nA. For any desired leakage current Ileak, set $Vgs=-n*VT*\log_{10}(Ileak/Iref)$ where n=ss/60 (VT is the thermal voltage 0.026 V at room temperature), Iref is the reference current, ss is the subthreshold slope in mV/decade. This will hold the leakage current constant across process and temperature, and has the benefit that offstate leakage can be directly controlled by modulating Iref.

Figure 5:
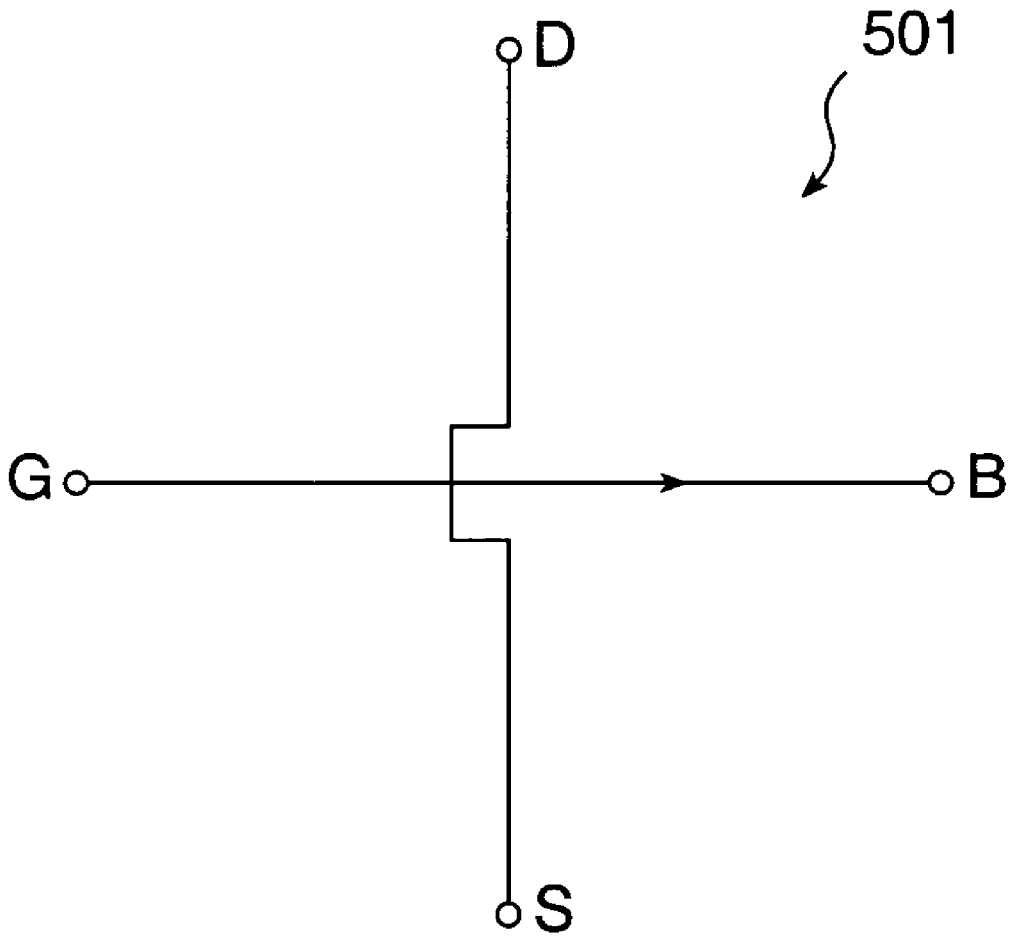
FIG. 5 shows a PFET which may be employed in place of the NFET shown in FIG. 4.

As explained above, the technique of the present invention at least partially resides in setting the gate bias to some negative potential to force the device into the subthreshold region, and then to maintain the drain current at a fixed value. Many structural variations for realizing such a technique may be contemplated by those skill in the art. As one example only, as shown in FIG. 5 a p-channel FET 501 may be employed as the test transistor, in which case the potential at which the gate voltage is held may be between +500 mV and +50 mV, the reference current may be between −0.01 and −100 nA, and the threshold voltage may be more than the gate voltage minus 500 mV. In this respect, the present invention has been described by way of specific exemplary embodiments, and the many features and advantages of the present invention are apparent from the written description. Thus, it is intended that the appended claims cover all such features and advantages of the invention. Further, since numerous modifications and changes will readily occur to those skilled in the art, it is not desired to limit the invention to the exact construction and operation as illustrated and described. Hence all suitable modifications and equivalents may be resorted to as falling with the scope of the invention.

What is claimed is:

1. A semiconductor circuit comprising:

a transistor having a drain, a source, a channel region, a bulk and a gate;

first voltage sources which respectively hold a first potential across said gate and said source and a second potential across said drain and said source to values at which a drain-to-source current through said channel is subthreshold;

a current source which outputs a reference current;

a comparator which compares the reference current with the subthreshold drain-to-source current through said channel; and a second voltage source which adjusts a bias potential of said bulk according to an output of said comparator to hold the subthreshold drain-to-source current through said channel at the reference current.

2. A semiconductor circuit as claimed in claim 1, wherein said transistor is an n-channel transistor, and wherein the first potential is a negative potential.

3. A semiconductor circuit as claimed in claim 1, wherein said first potential is between −500 mV and −50 mV, wherein said reference current is between 0.01 and 100 nA, and wherein a threshold voltage of the transistor is less than the first potential plus 500 mV.

4. A semiconductor circuit as claimed in claim 1, wherein said transistor is a p-channel transistor, and wherein the first potential is a positive potential.

5. A semiconductor circuit as claimed in claim 4, wherein said first potential is between +500 mV and +50 mV, wherein said reference current is between −0.01 and −100 nA, and wherein a threshold voltage of the transistor is more than the first potential minus 500 mV.

6. A method for compensating for temperature variations in a semiconductor circuit having a transistor, the transistor having a drain, a source, a channel region, a bulk and a gate, said method comprising:

holding a first potential across the gate and the source and a second potential across the drain and the source to preset potentials at which a drain-to-source current through said channel is subthreshold;

comparing a drain-to-source channel current of the channel region with a reference current to obtain a comparison result; and, adjusting a bias potential of the bulk according to the comparison result to hold the subthreshold drain-to-source channel current at the reference current.

7. A method as claimed in claim 6, wherein said transistor is an n-channel transistor, and wherein the first potential is a negative potential.

8. A method as claimed in claim 7, wherein said first potential is between −500 mV and −50 mV, wherein said reference current is between 0.01 and 100 nA, and wherein a threshold voltage of said transistor is less than the first potential plus 500 mV.

9. A semiconductor circuit as claimed in claim 6, wherein said transistor is a p-channel transistor, and wherein the first potential is a positive potential.

10. A semiconductor circuit as claimed in claim 9, wherein said first potential is between 500 mV and 50 mV, wherein said reference current is between −0.01 and −100 nA, and wherein a threshold voltage is less than more than the the first potential minus 500 mV.

* * * * *